US008557363B2

(12) United States Patent
Van Balen et al.

(10) Patent No.: US 8,557,363 B2
(45) Date of Patent: Oct. 15, 2013

(54) ARTIFICIAL GRASS TURF SYSTEM

(75) Inventors: Jeroen Albert Van Balen, Hengelo (NL); Marc Verleyen, Desselgem-Waregem (BE)

(73) Assignee: Ten Cate Thiolon B.V. (NL)

( * ) Notice: Subject to any disclaimer, the term of this patent is extended or adjusted under 35 U.S.C. 154(b) by 1011 days.

(21) Appl. No.: 11/884,134

(22) PCT Filed: Feb. 24, 2006

(86) PCT No.: PCT/NL2006/000096

§ 371 (c)(1),
(2), (4) Date: Apr. 11, 2008

(87) PCT Pub. No.: WO2006/091085

PCT Pub. Date: Aug. 31, 2006

(65) Prior Publication Data

US 2009/0162578 A1 Jun. 25, 2009

(30) Foreign Application Priority Data

Feb. 28, 2005 (WO) ..... PCT/NL2005/000144

(51) Int. Cl.
*E01C 13/08* (2006.01)
*D05C 17/02* (2006.01)
*D05C 15/00* (2006.01)

(52) U.S. Cl.
USPC ..... 428/89; 428/17; 428/87; 139/2; 139/391

(58) Field of Classification Search
USPC ..... 428/89, 87, 92, 17
See application file for complete search history.

(56) References Cited

U.S. PATENT DOCUMENTS

| | | | | |
|---|---|---|---|---|
| 3,513,061 | A * | 5/1970 | Vinicki | 428/17 |
| 3,549,724 | A | 12/1970 | Okazaki et al. | |
| 3,565,742 | A | 2/1971 | Stephens et al. | |
| 3,837,980 | A | 9/1974 | Nishimura et al. | |
| 4,044,179 | A | 8/1977 | Haas, Jr. et al. | |
| 4,176,150 | A | 11/1979 | Bromley et al. | |
| 4,337,283 | A | 6/1982 | Haas, Jr. et al. | |
| 5,006,057 | A | 4/1991 | Bagrodia et al. | |
| 5,922,462 | A | 7/1999 | Kent et al. | |
| 6,753,049 | B2 * | 6/2004 | De Vries | 428/17 |
| 6,815,059 | B2 | 11/2004 | Slootweg et al. | |
| 6,955,841 | B2 | 10/2005 | Weghuis et al. | |
| 2001/0033902 | A1 | 10/2001 | Seaton | |

(Continued)

FOREIGN PATENT DOCUMENTS

| | | |
|---|---|---|
| EP | 0259940 | 3/1988 |
| EP | 0432272 | 6/1991 |

(Continued)

*Primary Examiner* — Cheryl Juska
(74) *Attorney, Agent, or Firm* — Olson & Cepuritis, Ltd.

(57) ABSTRACT

An artificial grass turf carpet comprises a ground structure having an upper surface and upstanding synthetic grass fibers attached to the ground structure, which synthetic grass fibers form a grass surface of the artificial grass turf. The carpet further has upstanding synthetic base layer fibers attached to the ground structure at positions between the upstanding synthetic grass fibers. The base layer fibers have a lower height than the grass fibers. The base layer fibers are positioned tight against one another and against neighboring grass fibers, so that a dense base layer is obtained above which the grass fibers extend. An artificial grass turf system includes such a carpet and preferably includes a thin, rubber-free infill layer on top of the base layer.

34 Claims, 1 Drawing Sheet

(56) References Cited

U.S. PATENT DOCUMENTS

| | | | | |
|---|---|---|---|---|
| 2003/0099787 | A1 | 5/2003 | Fink | |
| 2003/0108688 | A1 | 6/2003 | De Vries | |
| 2003/0157275 | A1 | 8/2003 | Weghuis et al. | |
| 2004/0229007 | A1* | 11/2004 | Motz et al. | 428/92 |
| 2005/0064112 | A1 | 3/2005 | Nicholls et al. | |
| 2005/0238823 | A1 | 10/2005 | Weghuis et al. | |
| 2006/0159917 | A1* | 7/2006 | Verleyen | 428/364 |
| 2006/0216458 | A1* | 9/2006 | Gilman et al. | 428/87 |
| 2007/0237921 | A1* | 10/2007 | Knapp et al. | 428/92 |
| 2008/0124496 | A1* | 5/2008 | Avery | 428/17 |
| 2008/0125237 | A1* | 5/2008 | Avery | 473/278 |
| 2009/0041956 | A1* | 2/2009 | Gilman et al. | 428/17 |
| 2010/0105497 | A1* | 4/2010 | Avery | 473/278 |

FOREIGN PATENT DOCUMENTS

| | | |
|---|---|---|
| EP | 1158099 | 11/2001 |
| EP | 1386944 | 2/2004 |
| EP | 1389649 | 2/2004 |
| EP | 1378592 | 9/2004 |
| GB | 938768 | 10/1963 |
| JP | 06-158609 | 6/1994 |
| JP | 07-145548 | 6/1995 |
| WO | WO 02/00973 | 1/2002 |
| WO | WO 03/082965 | 10/2003 |
| WO | WO 2004/041721 | 5/2004 |
| WO | WO 2004/106601 | 12/2004 |
| WO | WO 2005/005730 | 1/2005 |
| WO | WO 2005/047602 | 5/2005 |

* cited by examiner

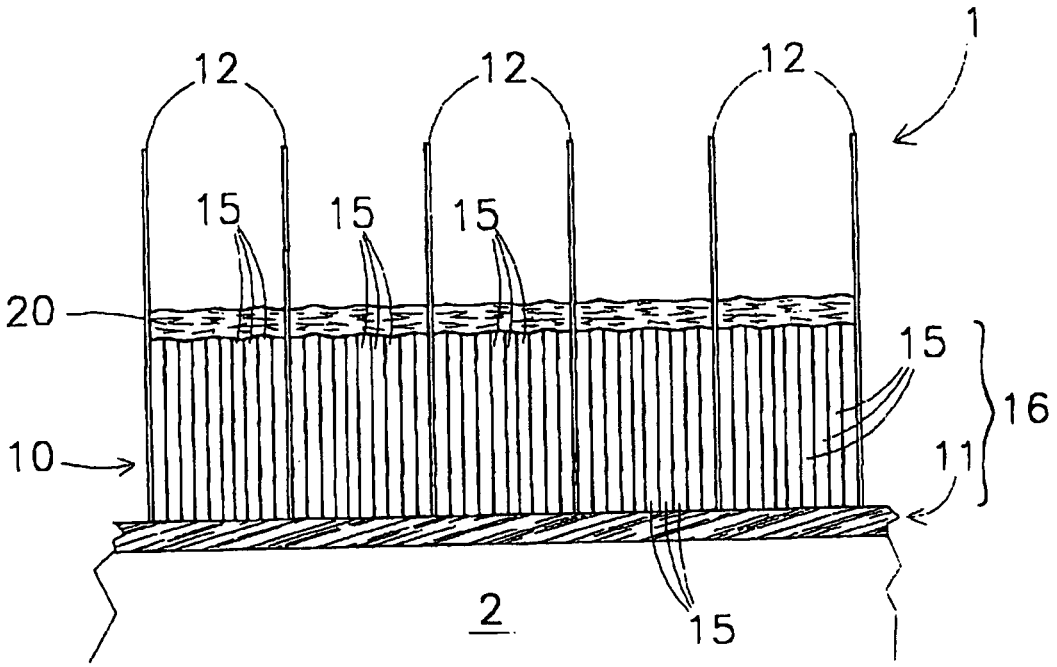
1
12
12
12
15
15
15
20
15
16
10
11
2
15

ARTIFICIAL GRASS TURF SYSTEM

This application claims priority based on International Application No. PCT/NL2005/000144 filed Feb. 28, 2005 and is the national Stage of International Application No. PCT/NL2006/000096 filed on Feb. 24, 2006, which are incorporated herein by reference.

The present invention relates to an artificial grass turf carpet and an artificial grass turf system including such a carpet.

From the prior art, many artificial grass turf systems are known.

Recently, the Federation Internationale de Football Association (FIFA) allowed the use of artificial grass turf systems for soccer. These artificial grass turf systems, in general, are "third generation" turf systems, having synthetic grass fibers of considerable length, for example, up to 70 mm, and a thick infill layer on top of the ground structure between the grass fibers. These artificial grass turf systems generally have an infill layer of rubber granules or particles, sometimes mixed with sand.

Many different aspects are involved in artificial grass turf systems. These aspects include such things as: ball/surface interaction (vertical ball rebound, ball roll, etc.), player/surface interaction (such as deformation, slip resistance, traction, etc.), and also shock absorption and energy restitution.

The present invention aims to provide an improved artificial grass turf carpet and an artificial grass turf system including such a carpet.

In particular, the present invention aims to provide an artificial grass turf system highly suitable for sports, in particular for soccer, but also for American football, rugby and other ball or contact sports.

The turf system could also be used for other purposes, such as playgrounds, landscaping, etc.

According to a first aspect thereof, the present invention provides an artificial grass turf carpet comprising:

a ground structure having an upper surface, synthetic grass fibers upstanding from said ground structure, which synthetic grass fibers form a grass surface of said artificial grass turf, synthetic base layer fibers upstanding from said ground structure at positions between the synthetic grass fibers, said base layer fibers having a lower height than said grass fibers, wherein said base layer fibers are positioned tight against one another and against neighboring (adjacent) grass fibers, so that a dense base layer is obtained above which the synthetic grass fibers extend.

In a particular embodiment, the present invention envisages that such a carpet is used in an artificial grass turf system, wherein an infill layer, preferably of one or more particulate materials, is placed on top of said base layer fibers.

The synthetic grass fibers will preferably have a resemblance to natural grass and, for example, be of a green color; in particular, a unicolor or a mixed shade of green and other colors.

Preferably, the grass fibers are bundles of monofilament extruded fibers with a geometry that ensures autonomous resilient behavior of the grass fibers. In another version, fibrillated tape could be used.

Preferably, the synthetic grass fibers are made of polyethylene because of its softness and low coefficient of friction of its surface.

The grass fibers could have a dtex between 6,000 and 16,000 dtex, preferably between 8,000 and 16,000 dtex, and are preferably formed of bundles of individual monofilaments that have a dtex between 500 and 2,500 dtex. Alternatively, single fibers with the same weight (fibrillated tapes) or bundles of slit tapes (so-called mono-tapes) with the same dtex could be used. Also different shapes of grass fibers can be bundled, and combined monofilaments with fibrillated and/or mono-slit tape artificial grass fibers can be employed.

The grass fibers could also include co-extruded filaments, i.e., yarns that have two or more materials in one filament, for example, nylon in the middle and polyethylene (PE) on the outsides.

In a preferred embodiment, the grass fibers have a thickness of at least about 80 microns and a width between about 1.3 and about 2.0 millimeters.

Preferably, the base layer fibers have a solid or monolithic cross-section, not made up from a bundle of filaments as is preferred for the grass fibers, but as a preferably thick, monofilament.

Preferably, the base layer fibers are relatively thick, preferably at least significantly thicker than the grass fibers.

Preferably, the base layer fibers have a greater stiffness than the grass fibers, more preferably a greater bending stiffness.

Preferably, a thermoplastic vulcanizate (TPV) is employed for the base layer fibers. This thermoplastic vulcanizate could include ethylene-propylene-diene terpolymers (EPDM) embedded in polypropylene (PP), such as EPDM particles embedded in a PP, PE or other polymer matrix.

As an alternative, the base layer fibers are made of a thermoplastic elastomer (TPE) or possibly a combination of several thermoplastic elastomers. Also, a thermoplastic oleofin (TPO) could be used. These materials are known for maintaining their relevant properties over a long time.

TPV and TPE are environmentally harmless materials and can be easily recycled.

In one embodiment, the base layer fibers include EPDM.

Preferably, the base layer fibers include a UV-stabilizer.

In another embodiment, the base layer fibers have a sand-like color.

Preferably, the base layer fibers have a minimum cross-sectional dimension of at least about 0.7 millimeter, preferably at least about 1 millimeter, more preferably at least about 1.5 millimeter, most preferably at least about 1.8 millimeter. Preferably, the relatively substantial thickness is provided in a monolithic cross-section of the base layer fibers.

In a practical embodiment, the base layer fibers have a maximum cross-sectional dimension of about 3 millimeters.

Selection of an appropriate cross-sectional dimension of the base layer fibers is preferably based on the turf system composition (e.g., use of impact damping underlayer) and/or applicable sports requirements.

Preferably, the base layer fibers have a height between about 5 and about 35 millimeters, more preferably between about 10 and about 30 millimeters, most preferably between about 10 and about 20 millimeters.

The infill layer covering the base layer fibers (when present) is preferably thin, in particular significantly thinner than prior art infill layers, e.g. within the thickness range of about 3-15 millimeters, preferably between about 4 and 10 millimeters.

The synthetic grass fibers are of such a length that they extend above the infill layer, e.g. by at least about 5, preferably at least about 10 millimeters, most preferably within a range of about 15-20 millimeters.

In an advantageous practical embodiment, the base layer fibers have a solid cross-section with a diameter of about 1.8-2.8 millimeters, e.g. a circular cross-section.

The inventive carpet and artificial grass turf system including such a carpet are expected to provide an excellent behavior over a long period of use. This compares favorably to prior art artificial grass turf systems, which suffer from compaction of the infill layer after prolonged use. The compaction results in the hardening of the turf, which negatively affects aspects as "ballbouncing" and "shock absorption" of the turf. It is noted that when a thin infill layer is used on top of the base layer, as is preferred, no detrimental compaction of the thin infill layer will occur.

The dense base layer obtained by the tight packed base layer fibers is considered to behave as a resilient layer, which in general restores after being compressed, e.g. by the players on the turf.

An effect expected to be achieved with the inventive carpet is that the base layer thereof effectively can act as a replacement of (at least most of) the particulate infill material, notably rubber material such as granules or particles, that is now used for the construction of an artificial grass turf system, in particular third generation turfs.

The dense and resilient base layer of the carpet is expected to produce the effect that the shoe of, for example, a soccer player achieves a grip on the turf essentially equal to the grip on a natural grass turf, primarily by the studs of the shoe penetrating into the turf, under circumstances into the base layer of the turf. This is particularly relevant in situations when the shoe is rotated on the turf, etc.

When played upon by a player, the base layer shows motion of its fibers in all directions, with the result that the infill layer when present is not compacted. This effect is likely to be enhanced when the infill layer covering the base layer is thin as explained above.

The resilient behavior of the base layer of the carpet is also expected to have an effect on the infill layer on top of the base layer in such a manner that the infill layer does not suffer from undesirable compaction.

It is envisaged that with the carpet according to the invention the need for particulate infill material is significantly reduced as compared to third generation artificial grass turf systems. It is even envisaged that the carpet can be used for sports without including any infill layer on top of the base layer.

It is further envisaged that the carpet according to the invention allows to dispense with rubber granules and the like "resilient infill materials" as are nowadays commonly proposed as infill materials.

It is considered highly advantageous that the infill be free of rubber granules or the like, as these granules are often environmentally undesirable (e.g. when recycled rubber (SBR) is used), because they contain substances like zinc sulphur, aromatic oils, etc. Also these granules are likely to cause undesirable high surface temperatures. In addition, turf systems including such particles tend to give off an undesirable smell when hot.

A further advantage of the non-use of rubber infill material is that recycling of the turf is easier.

In a preferred embodiment, the base layer fibers of the carpet are essentially straight and each have a foot portion attached to the ground structure and a non-looped upper free end.

In a further preferred embodiment, the base layer fibers are upright oriented cut-pile fibers.

In an alternative, the base layer contains base layer fibers in the form of loop piles. Possibly the base layer contains loop-piles only. As an alternative, the loop-piles could be combined with cut-piles, if desired.

In a highly advantageous embodiment, the carpet is woven.

Preferably, in the woven carpet, the base layer fibers are "cut-pile" fibers obtained by the weaving process.

Preferably, in the woven carpet, the grass fibers and the base layer fibers are woven together with a ground fabric yarn, so as to obtain an integral woven carpet having a ground fabric and grass fibers and base layer fibers extending from the upper surface thereof.

Preferably, a woven artificial grass turf carpet is manufactured on a suitable carpet weaving machine, preferably in a single run.

In an alternative embodiment, the carpet is manufactured using the "face-to-face" carpet weaving technique, wherein two carpets are simultaneously woven face-to-face on a single machine and separated from each other.

In another alternative embodiment, a single face weaving technique can be used.

It is an option to use the Axminster weaving technique wherein the height of the base layer fibers and grass fibers can be controlled individually. In an advantageous embodiment, an Axminster weaving loom allows control of the height of each pile point (each singular location where a fiber or bundle is connected to the ground fabric) individually using the Jacquard technology.

In a further alternative, needle knitting technology is used for the manufacture of the carpet.

Using the weaving technique for the manufacture of the carpet, it is possible to obtain a dense base layer in the carpet.

Also by using the weaving technique, a reliable locking can be obtained between the ground structure, on the one hand, and the base layer fibers and grass fibers on the other hand. This avoids the problem of fibers coming loose from the turf system, as is experienced in prior art tufted artificial grass carpets.

Also by using a suitable weaving technique, such as the "face-to-face" weaving technique, different heights of the base layer fibers and the grass fibers can be obtained in a single run.

Suitable yarns for the ground fabric are, for instance, polypropylene (tape) yarn, (spun) polyester yarn, jute yarn, etc.

The woven part of the ground structure, the ground fabric, is preferably covered on the underside with a coating layer as is known in the carpet finishing technology, such as a latex layer, a polyurethane layer, etc. It can also be envisaged that a further layer, e.g. a glass fiber layer, is fixed against the underside of the woven ground fabric. The underside of the ground fabric could also be covered by an impact absorbing layer.

Finishing can also be done in an inline process after the weaving, wherein a polymer powder, hotmelt coating, extrusion coating or combination thereof is employed. In a practical embodiment, first a hotmelt coating is applied, followed by a polymer powder coating.

In an alternative embodiment, the base layer fibers are fusion bonded to the ground structure, e.g. by ultrasonic welding.

Preferably, the dense base layer has a density such that the combined cross-sectional area of the grass fibers and base layer fibers—measured at the upper surface of the ground structure—is at least about 50%, more preferably at least about 60%, even more preferably at least about 70%, or even more preferably at least about 80%, and most preferably at least about 90% per unit of surface area of the carpet.

It might even be possible to achieve a density of about 100%, when the fibers are somewhat elastically compressed by the dense packing in the base layer.

With a "cut-pile design" of the base layer, the density is preferably at least about 70% as determined according to the formula indicated above.

Preferably, at least 3 or 4, preferably at least 7, more preferably between 7 and 9, base layer fibers are arranged between neighboring grass fibers.

To consider the density of the base layer and grass fibers, one could also resort to the definition of pile points, that is, locations where a single fiber or bundle of fibers is attached to the ground structure at a single location.

Preferably, between about 30 and about 160, more preferably between about 80-140, grass fibers are arranged per meter length of the carpet. When the carpet is woven, it is preferred to have this density of grass fibers both in warp and weft direction of the carpet, although it will not be necessary to have the same density in both directions.

Preferably, between about 300 to about 800, more preferably between about 400 and about 600, base layer fibers are arranged per meter length of the carpet. When the carpet is woven it is preferred to have this density of base layer fibers both in warp and weft direction of the carpet.

For instance, a carpet has 450 base layer fibers per meter and e.g. 50 grass fibers per meter, wherein the base layer fibers have a thickness of between about 2 mm, preferably with a circular cross-section, whereas the grass fibers are thinner, e.g. 1 mm.

In the above exemplary artificial grass turf carpet, the dense base layer has a density such that the combined cross-sectional area of the grass fibers and base layer fibers—measured at the upper surface of the ground structure—is now about 95% per unit of surface area of the carpet.

Preferably, the base layer fibers have a non-square cross-section, e.g. a circular or oval cross-section, more preferably a circular cross-section. Due to the non-square cross-section, narrow "vertical" interstices will be left open between adjacent base layer fibers. A small amount of infill material will enter into these interstices when suitable infill material is used, especially when the turf is compressed, e.g. by a player's shoe.

Preferably, the grass fibers have a length between about 35 to about 80 millimeters, preferably between about 40 and about 75 millimeters, more preferably between about 40 and about 55 millimeters.

Preferably, the base layer fibers are made of thermoplastic material, in particular a thermoplastic elastomer (TPE), or a thermoplastic olefin elastomer (TPO), or a thermoplastic vulcanizate (TPV).

A thermoplastic olefin elastomer (TPO) is, for example, manufactured from polypropylene/EPDM rubber, and is, for example, sold by DOW under the brand name BRANCOM.

A thermoplastic vulcanizate (TPV) is, for example, manufactured by DSM and sold under the brand name SARLINK.

Preferably, the grass fibers are essentially made of polyethylene, polypropylene, nylon or a combination of filaments from different materials and/or filament containing multiple materials. The grass fibers could be fibrillated or mono-filaments. Preferably the grass fibers are straight, but a curled design is also possible.

In an installed artificial grass turf system having an infill layer on top of the base layer fibers grass, it is likely that some infill material will enter into the interstices between the base layer fibers and grass fibers in the zone of the base layer. It is preferred that the density of the fibers in the base layer is such that when considering the volume of the base layer, the base layer volume contains less than about 30% of its volume, preferably less than about 20%, of infill material.

Preferably, the infill layer solely consists of sand, preferably quartz sand.

Preferably, the infill layer is free from rubber.

In a less favorable embodiment, sand is mixed with rubber infill particles or any other polymer substitute.

Further artificial grass turf carpets and preferred embodiments thereof according to the invention are described in the claims. It will be appreciated that these carpets can include one or more of the features described above. Also these carpets can be used as part of an artificial grass turf system, wherein an infill layer, e.g. having one or more features as described herein, is used as well.

Although at present weaving technology is highly preferred for the manufacturing of the carpet, it can be envisaged that tufting technique could also be used.

The present invention also relates to the manufacturing of the carpet and to a base layer fiber yarn for the carpet.

The present invention also envisages that an organic material instead of a synthetic material can be used for the base layer fibers.

BRIEF DESCRIPTION OF THE DRAWING

The invention will now be explained with reference to the drawing. In the drawing:

FIG. 1 shows highly schematically a side view of a part of an example of an artificial turf system according to the present invention.

DETAILED DESCRIPTION

FIG. 1 shows a portion of an artificial grass turf system 1 according to the present invention. In actual practice, FIG. 1 could represent a section of about 10 centimeters of such a system.

The artificial grass turf system 1 is placed on a supporting substrate 2 which is not further described in detail here. This substrate 2 is preferably water permeable, and can include a drainage facility.

The turf system 1, in this example, is essentially composed of an artificial grass turf carpet 10 and an infill layer 20 of particulate infill material.

The artificial grass turf carpet 10 is an integrally woven artificial grass turf carpet, made on a carpet weaving machine using suitable yarns.

Preferably, the carpet 10 is woven in a single run on such a machine, preferably on a "face-to-face" carpet weaving machine.

The carpet 10 has a ground structure, here embodied as a ground fabric 11, including a ground fabric yarn and having an upper surface.

Synthetic grass fibers 12 are woven integral with the ground structure 11, which synthetic grass fibers 12 extend upward from the ground structure and form a grass surface of the artificial grass turf.

In FIG. 1, the upper ends of the grass fibers 12 are shown in a "straight-up" position. It will be appreciated that in actual practice these grass fibers 12 will not be in that position. The filaments of the grass fibers will basically bend and cover (at least partly) the infill layer 20.

The carpet 10 further includes synthetic base layer fibers 15 woven integral with the ground structure 11 at positions between the synthetic grass fibers 12.

Due to the nature of the weaving process in this example, the ground fabric 11 is made up by the ground fabric yarn as well as the base layer fibers 15 and the grass fibers 12.

The base layer fibers 15 have a lower height than the grass fibers 12. In this example, the length of the grass fibers 12 is about 50 millimeters, and the length of the base layer fibers is about 25 millimeters.

As is preferred, the base layer fibers 15 have a substantially greater stiffness, in particular bending stiffness, than the grass fibers 12. This can be obtained, for example, by selecting the cross-section of the base layer fibers substantially greater than that of the grass fibers and/or manufacturing a base layer wire as a solid cross-section fiber (as a wire) instead of as a bundle of filaments and/or suitable selection of the material of the base layer fibers.

Preferably, the carpet 10 is woven using the face-to-face carpet weaving technique, wherein a bottom carpet and a top carpet are woven at the same time on a machine and the interlaced pile warp ends are cut by a cutting device, e.g. a knife.

This face-to-face weaving technique is not only highly efficient, but also provides a dense base layer. It also produces the two different heights of the base layer fibers and the grass fibers, respectively. This can be done by having the knife of the face-to-face carpet weaving machine cut through the base layer fibers yarn in a zone where this yarn is still connecting the two carpets, when the ground fabrics of both carpets are spaced apart at a first distance (e.g. about twice the base layer fiber height), and then move the ground fabrics in this zone further apart to a second distance, greater than said first distance (e.g. about twice the grass fiber height), and then have the knife cut through the grass fiber yarn.

The base layer fibers 15 are positioned tight against one another and, in this example, also against neighboring grass fibers 12, so that a dense base layer 16 or "base zone" of the carpet is obtained. The longer grass fibers 12 extend above this base layer.

As far as weaving of the carpet is concerned, it is envisaged that tension control during the weaving at the moment of cut allows the effective height of the fibers in the carpet to be determined. Due to their elastic nature, a fiber under relatively high tension will retract to a lower effective height in the carpet than when placed under less tension at the moment of cut.

The present invention also includes the method of weaving an artificial turf carpet wherein this tension control technique is employed and an artificial turf carpet is obtained thereby.

In this example, the base layer fibers 15 are each of a solid cross-section, e.g. a circular cross-section, having a diameter in this example of approximately 2 millimeters.

The grass fibers 12, formed here as bundles of monofilaments, could have a diameter of about 1 millimeter in this example.

In this example, the carpet has about 450 base layer fibers per meter and about 50 grass fibers per meter.

In this exemplary artificial turf carpet 10, the dense base layer 16 thus has a density such that the combined cross-sectional area of the grass fibers 12 and base layer fibers 15—measured at the upper surface of the ground structure 11—is now about 95% per unit of surface area of the carpet 10.

The infill layer 20 is thin when compared to prior art infill layers. In this example, the thickness of the infill layer is about 5 millimeters, measured above the dense base layer 16.

It is noted that the dense base layer 16 here essentially consists of the base layer fibers 15 and grass fibers 12. No substantial amount of infill material is present between the upstanding fibers 12, 15 in the base layer 16. Therefore, the resilient behavior of the base layer 16 is governed essentially by the thick and densely packed base layer fibers 15. As mentioned above, it can even be envisaged that no infill material is present in the field to be played on (e.g. indoors).

With the density shown here, the base layer volume contains less than about 30% of its volume, preferably less than about 20%, of infill material.

The infill layer 20 here solely consists of sand, preferably quartz sand. In particular, the infill layer 20 is free from rubber.

As shown in FIG. 1, the base layer fibers 15 here are essentially straight and each have a foot attached to the ground structure 11 and a non-looped upper free end. As is known in the art of carpet weaving, these base layer fibers 15 are upright oriented cut-pile fibers.

In this example, the base layer fibers 15 are made of a thermoplastic elastomer (TPE). A thermoplastic vulcanizate (TPV), e.g. including EPDM and PP, could also be used.

The grass fibers 12 are essentially made of a bundle of polyethylene filaments in this example.

The ground structure 11 will, in a practical embodiment, not only include the woven fabric part made up by the ground fabric yarn, the base layer fibers and the grass fibers, but also include a coating layer or other secondary layer covering the underside of this woven fabric part. This is common in carpet finishing practice. For example, a latex layer or a polyurethane layer is provided.

The ground structure could also include an impact absorbing resilient layer adhered under the woven fabric part. Such a layer will, for example, allow for installation of the field on a relatively hard floor, such as in an indoor sports facility.

The impact absorbing resilient layer could include a thermoplastic foam material, e.g. a closed cell foam material.

The turf according to the present invention can be installed permanently at a site, but it is also envisaged that the turf can be installed to be removable, e.g. for a specific season, tournament, etc.

It is envisaged that according to one embodiment the turf system is manufactured in the form of panels, so that a subsurface can be covered by multiple adjacent panels.

Preferably, such panels are portable, e.g. by two persons, so that they can easily be positioned to form a field. Such panels could, for example, measure about 80 centimeters by about 120 centimeters. For instance, the weight of a panel is less than 50 kilograms.

Such panels can have associated connection means to interconnnect the panels, e.g. Velcro, tongue and groove members, etc.

According to one manufacturing method, the carpet is woven and then coiled into large rolls (e.g. having a width of more than about 2 meters). These rolls can then be unrolled and the pile points emerging below the ground fabric are secured using a first coating. Then a further, covering coating is applied to the underside, possibly with the addition of a covering layer (such as a non-woven or woven fabric). Then the carpet can again be coiled or cut into panels.

It is also envisaged that the artificial turf carpet disclosed herein is employed without an infill layer being present. The design of the inventive carpet already allows for use without such infill for many applications.

In particular, in an embodiment wherein the turf/carpet is manufactured in the form of panels, such use without an infill layer is advantageous, as the field can be installed quickly by means of the panels and then no additional operation is needed to apply the infill layer.

Use without an infill layer is particularly attractive when the field to be installed is to be used indoors and/or as temporary field.

In a preferred embodiment, it is envisaged that use of the turf carpet without an infill layer takes place with each panel having an impact absorbing resilient layer adhered to the underside of the turf carpet structure. Any connection means for interconnecting panels could be positioned in or on said impact absorbing resilient layer, e.g. a tongue and groove.

In another embodiment, the turf carpet is manufactured (preferably woven) with base layer fibers in closed loop-pile design. In this loop-pile design of the base layer, the dense base layer also can be obtained with the properties disclosed above. In particular, one can envisage the use of a thick, solid cross-section base layer fiber, e.g. of suitable materials and cross-sectional dimensions suggested herein. The thickness of the base layer fiber provides a relatively stiff (compared to the grass fibers) and resilient loop-pile structure in the base layer of the carpet.

For instance, a solid cross-section base layer fiber is chosen with a minimum cross-sectional dimension of about 1.5 millimeters for the base layer to obtain advantageous base layer behavior. By providing close spacing between the loop-piles, a density of the combined cross-sectional area of the grass fibers and base layer fibers—measured at the upper surface of the ground structure—of more than about 50% can be achieved, which is preferred. The closed loops of such thick base layers fibers will more or less (depending, for example, on their stiffness, shape and spacing) be squeezing against one another in the base layer of the carpet and against the grass fibers and thus provide the desired dense base layer.

What is claimed is:

1. An artificial grass turf carpet comprising:

a ground structure having an upper surface, a plurality of spaced-apart synthetic grass fibers attached to and upstanding from said ground structure, which synthetic grass fibers form a grass surface of said artificial grass turf, and a resilient, dense base layer comprising a plurality of synthetic base layer fibers attached to and upstanding from said ground structure, and positioned between the upstanding synthetic grass fibers, said base layer fibers having a lower height and a greater stiffness than said grass fibers, wherein the base layer fibers are positioned tight against one another and against adjacent grass fibers to provide a tightly packed base layer above which the grass fibers extend, wherein the dense base layer has a density of between about 300 and about 800 base layer fibers per meter length of carpet, and the combined cross-sectional area of the grass fibers and base layer fibers, measured at the upper surface of the ground structure, is at least about 90% per unit of the surface area of the grass turf carpet, and wherein the resiliency of the dense base layer is substantially restored after being compressed, such that the presence of infill material is optional for compressive use of the artificial grass turf carpet.

2. The carpet according to claim 1, wherein the base layer fibers are essentially straight and each has a foot portion attached to the ground structure and a non-looped upper free end.

3. The carpet according to claim 1, wherein said base layer fibers are upright oriented cut-pile fibers.

4. The carpet according to claim 1, wherein said carpet is a woven carpet.

5. The carpet according to claim 4, wherein said carpet is woven according to a face-to-face weaving method.

6. The carpet according to claim 1, wherein said base layer fibers are bonded to said ground structure.

7. The carpet according to claim 1, wherein the dense base layer comprises at least three synthetic base layer fibers.

8. The carpet according to claim 1, wherein said base layer fibers have a minimum cross-sectional dimension of at least about 0.7 millimeters.

9. The carpet according to claim 1, wherein said base layer fibers have a non-square cross-section.

10. The carpet according to claim 1, wherein said base layer fibers have a solid cross-section.

11. The carpet according to claim 1, wherein the grass fibers have a length between about 35 to about 80 millimeters.

12. The carpet according to claim 1, wherein the base layer fibers have a height between about 5 and about 35 millimeters.

13. The carpet according to claim 1, wherein the base layer fibers comprise a material selected from the group consisting of a thermoplastic elastomer, a thermoplastic olefin, and a thermoplastic vulcanizate.

14. The carpet according to claim 1, wherein the grass fibers comprise a material selected from the group consisting of a polyethylene and a polypropylene.

15. The carpet according to claim 1, wherein said carpet is woven and the ground structure comprises a fabric yarn which is coated on its underside with a coating layer selected from the group consisting of a latex and a polyurethane.

16. An artificial grass turf system comprising a carpet according to claim 1, wherein an infill layer comprising a particulate material is present on the top surface of said base layer fibers at an infill layer thickness in the range of between about 3 and about 15 millimeters measured above the surface of the dense layer, allowing the grass fibers to extend above the infill, the dense base layer substantially maintaining the infill material on top of the base layer, and the base layer volume containing less that about 30% of infill material.

17. The grass turf system according to claim 16, wherein said infill layer has a thickness between about 4 and about 10 millimeters.

18. The grass turf system according to claim 16, wherein the base layer volume contains less than about 20% of its volume of infill material.

19. The grass turf system according to claim 16, wherein the infill layer is a sand.

20. The grass turf system according to claim 16, wherein the infill layer is free from rubber.

21. A method for installing an artificial turf system comprising the steps of placing an artificial grass turf carpet according to claim 1 on a supporting substrate, and placing an infill layer comprising a particulate material on top of said base layer fibers between said upwardly extending grass fibers.

22. The method according to claim 21, wherein said infill layer is a sand.

23. A sports field including an artificial grass turf carpet according to claim 1.

24. A method for manufacturing an artificial grass turf carpet according to claim 1 comprising the steps of integrally weaving together a weft fabric yarn in a fabric ground structure, a base layer fiber yarn for the base layer fibers, and a synthetic grass fiber yarn for the grass fibers.

25. The method according to claim 24, wherein said base layer fiber yarn is selected from the group consisting of a thermoplastic elastomer, a thermoplastic olefin, and a thermoplastic vulcanizate.

26. The method according to claim 24, wherein said base layer fiber yarn has a minimum cross-sectional dimension of at least about 0.7 millimeters.

27. A woven artificial grass turf carpet comprising:

a ground fabric comprising a fabric yarn and having an upper surface, a plurality of spaced-apart upstanding synthetic grass fibers woven integrally with said ground fabric, which synthetic grass fibers form a grass surface of said artificial grass turf, and a resilient, dense base layer comprising a plurality of synthetic base layer fibers woven integrally with said ground fabric and positioned between the upstanding synthetic grass fibers, said base layer fibers having a lower height and a greater stiffness than said grass fibers, wherein the woven base layer fibers are positioned tight against one another and against adjacent grass fibers to provide a tightly packed base layer above which the grass fibers extend, wherein the dense base layer has a density of between about 300 and about 800 base layer fibers per meter length of carpet, and the combined cross-sectional area of the grass fibers and base layer fibers, measured at the upper surface of the ground structure, is at least about 95% per unit of the surface area of the grass turf carpet, and wherein the resiliency of the dense base layer is substantially restored after being compressed, such that the presence of infill material is optional for compressive use of the woven artificial grass turf carpet.

28. A sports field comprising at least one panel comprising an artificial grass turf carpet according to claim 1, wherein an infill layer is absent.

29. An artificial grass turf carpet for an indoor facility comprising at least one panel of an artificial grass turf carpet according to claim 1, wherein an infill layer is absent.

30. The artificial grass turf carpet according to claim 27 wherein the base layer fiber yarn is selected from the group consisting of a thermoplastic elastomer, a thermoplastic olefin and a thermoplastic vulcanizate.

31. The woven carpet according to claim 27, wherein said base layer fibers are thicker than said grass fibers, and said base layer fibers have a minimum cross-sectional dimension of at least about 0.7 millimeter.

32. The artificial grass turf carpet of claim 27 wherein an infill material is present covering the top of the base layer at an infill layer thickness in the range of between about 3 and about 15 millimeters, measured above the surface of the dense base layer, allowing the grass fibers to extend above the infill, the dense base layer substantially maintaining the infill material on top of the base layer, and the base layer volume containing less than about 20% of infill material.

33. An artificial grass turf carpet for sports play thereon comprising:

a ground structure having an upper surface, a plurality of spaced-apart synthetic grass fibers attached to and upstanding from said ground structure, wherein between about 30 and about 160 grass fibers are arranged per meter length of said carpet, which synthetic grass fibers form a grass surface of said artificial grass turf, and a resilient, dense base layer comprising a plurality of synthetic base layer fibers attached to and upstanding from said ground structure, wherein between about 300 and about 800 base layer fibers are arranged per meter length of said carpet, said base layer fibers having a lower height and a greater stiffness than said grass fibers, wherein the base layer fibers are positioned between the grass fibers and tight against one another and against adjacent grass fibers to provide a tightly packed base layer above which the grass fibers extend, the combined cross-sectional area of the grass fibers and base layer fibers, measured at the upper surface of the ground structure, is at least about 95% per unit of the surface area of the grass turf carpet, and wherein the resiliency of the dense base layer provides damping and is substantially restored after being compressed during sports play thereon such that the presence of infill material is optional for compressive use of the artificial grass turf carpet.

34. The artificial grass turf carpet of claim 33 wherein infill material is present in a layer covering the top of the base layer at an infill layer thickness in the range of between about 3 and about 15 millimeters measured above the surface of the dense base layer, allowing the grass fibers to extend above the infill, wherein the dense base layer substantially maintains the infill on top of the base layer, and the base layer volume contains less than about 20% of infill material, and compressive compaction of the infill material is avoided.

* * * * *